United States Patent [19]

Rosenfeld

[11] Patent Number: 4,572,223

[45] Date of Patent: Feb. 25, 1986

[54] DENTAL BRUSH HOLDER AND ASSEMBLY

[75] Inventor: Marvin L. Rosenfeld, Manhattan Beach, Calif.

[73] Assignee: Dentool, Inc., Manhattan Beach, Calif.

[21] Appl. No.: 530,869

[22] Filed: Sep. 12, 1983

[51] Int. Cl.[4] ..... A45D 44/18

[52] U.S. Cl. ..... 132/84 R; 132/84 D; 132/85; 15/167 R

[58] Field of Search ..... 132/84 R, 85, 84 A, 132/84 B, 84 C, 84 D, DIG. 1; 15/167 R, 167 A, 105, 206

[56] References Cited

U.S. PATENT DOCUMENTS

| | | | |
|---|---|---|---|
| 3,939,520 | 2/1976 | Axelsson | 132/93 |
| 4,222,143 | 9/1980 | Tarrson et al. | 15/105 |
| 4,387,479 | 6/1983 | Kigyos | 15/167 R |
| 4,395,943 | 8/1983 | Brandli | 15/167 R |
| 4,399,582 | 8/1983 | Ernest et al. | 132/84 R |

*Primary Examiner*—Gene Mancene
*Assistant Examiner*—Carolyn A. Harrison
*Attorney, Agent, or Firm*—Willie Krawitz

[57] ABSTRACT

An assembly of a holder and dental brush is disclosed for massaging the gums, and cleaning around and between the teeth. The assembly comprises an elongate, molded plastic including a central holding arm, and angled ends integrally formed with the arm. Each end forms a slit portion that is compressable by means of a small moveable ring. At least one slot is provided in each angled end for receiving a correspondingly shaped handle of a cleaning brush, the slot being formed within the compressible slit. The dental brush is inserted by its stem into the slit and then moved into the slot to form an initial friction fit. The slot is then compressed by sliding a compression ring over the slit to compress the slot and secure the stem and brush in place.

The device enables a user to manipulate the brush at an angle to the teeth and gums and effect a good cleaning and massaging action.

16 Claims, 7 Drawing Figures

DENTAL BRUSH HOLDER AND ASSEMBLY

BACKGROUND OF THE INVENTION

This invention relates to a new and improved device for cleaning the teeth, massaging the gums, and the like. More specifically, the invention provides a cleaning brush holder and brush assembly that is used for insertion between and around the teeth, and for movement along the gum lines. The holder is adapted to position and secure the brush in a relatively rigid, upright manner by means of a moveable compression ring. Advancement or retraction of the compression ring enables the brush to be secured for use or to be removed.

Many dental problems arise from the presence of plaque that is caused by various factors. The removal of plaque on a frequent and consistant basis is necessary to reduce tooth decay and gum problems. In addition, cleaning around and between the teeth is necessary to remove food particles and plaque and also to massage the gum areas. While brushing and flossing the teeth on a regular basis will, of course, reduce bacteria and plaque formation, it is usually quite difficult to clean between and behind the teeth. Also, plaque should be removed every twenty-four hours.

Frequently, forcing a small brush around and between the teeth and massaging along the gum areas would be of considerable benefit. However, it is difficult to manufacture a brush that is sufficiently long and stiff to be manipulated by hand, while being sufficiently thin and flexible for insertion between, around and behind the back molars. Consequently, a holder is almost necessary that can easily engage such a small brush for the above cleaning and massaging purposes. Preferably, the holder should provide surface contours that can be easily cleaned and sterilized, if necessary, and hence be reuseable.

The type of brush holder contemplated should be manufactured from inexpensive plastic materials to achieve high production rates, such as by injection molding, without requiring a complex design. Also, the holder should be adapted to easily engage with and disengage from the brush using a minimum of moving parts.

Furthermore, the areas of the holder that engage the brush should not be subject to excessive stress distortion; this will provide a longer use life.

In addition, the holder should be configured to facilitate using the brush at various angles, rather than simply a head-on application.

One type of brush holder is described in U.S. Pat. No. 4,222,143; however, that device is difficult to manipulate, and the brush tends to bend readily. Also, the patented device employs a locking ring that is removeable from the holder and can be lost.

THE INVENTION

According to the invention, a holder device for a brush is provided, the brush being adapted to clean between and around teeth, and for massaging gums, comprises: an elongate, integrally molded, plastic holder, including: i. a central member; ii. at least one end portion at each end of the central member, and preferably inclined thereto; iii. an outwardly shaped slit formed along each end portion and defining a slot for insertion of the brush and frictional engagement therein; and, iv. at least one compression ring adapted for advancement along the slit to compress the slit and the slot to secure the brush therein, and for retraction along the slit, thereby allowing the slit to expand and to permit removal of the brush.

DESCRIPTION OF THE PREFERRED EMBODIMENTS

Figure 1:
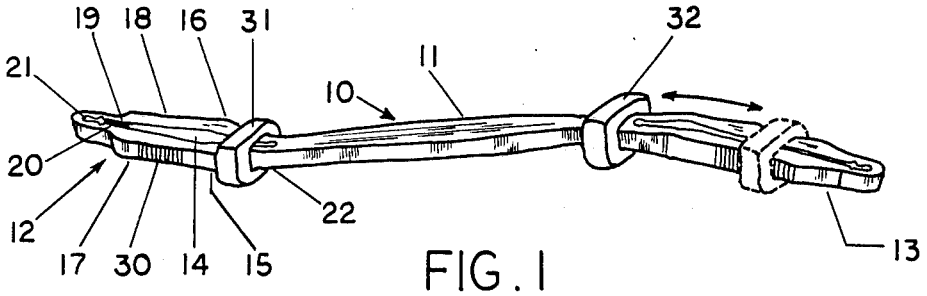
FIG. 1 is an external perspective view showing the dental brush holder of this invention.

The dental brush holder 10 of this invention is shown in FIG. 1, and comprises a central portion 11 and end members 12, 13 angled (about 15°) thereto. The brush holder is manufactured of a moldable material such as polypropylene, nylon, low and high density polypropylene, etc., and this enables the manufacture of an integrally formed holder. The end member 12 provides a slit 14 that is outwardly formed into inclined sidewalls 15, 16, approximately parallel medial walls 17, 18, and inclined sidewalls 19, 20 that terminate in a closed end 21. The end member 13 has the same or a similar configuration. An interior end 22 of the slit 14 (FIG. 3) defines a slot 25, and the exterior end 26 of the slit also defines adjacent slots 27, 28. Slots 25, 28 are provided to impart flexibility and stress relief.

A plurality of ridges 30 are defined on the outer sides of the parallel walls 17, 18 to improve frictional engagement with a compression ring 31, a corresponding ring 32 being provided for the other end member 13. These rings are forced onto the brush holder 10 after softening in boiling water. When the plastic has cooled, it is extremely difficult to remove the ring from the holder.

Figure 2A:
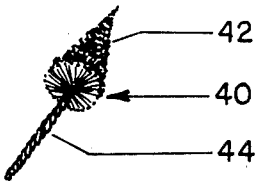
FIGS.2A and 2B are external views in side elevation showing two embodiments of a tooth cleaning and massage brush suitable for use with the brush holder of FIG. 1.
Figure 2B:
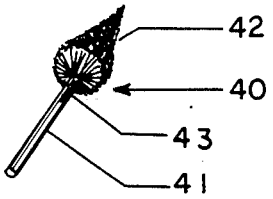

A suitable brush 40 for use in cleaning around and between the teeth, and for gum massaging, is shown in FIGS. 2A and 2B. This comprises a handle portion 41 having bristles 42 with a conical shaped profile. Other bristle profiles are, of course, suitable such as a right circular cylinder, an elliptical cylinder, planar, etc. The handle portion 41 is preferably encased in a hollow plastic tube 43, as shown in FIG. 2A. In FIG. 2B, the handle portion 44 is shown as a twisted wire having a thinner cross section than that of the tube 43.

Figure 3:
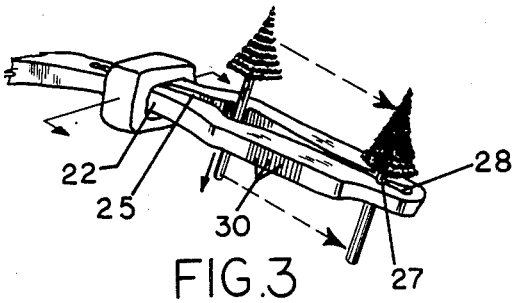
FIGS. 3–5 are external perspective views showing angled end portions of the brush holder of this invention illustrating insertion and locking sequences of the brush into the holder; and, FIG. 6 is an upper, external perspective view showing the operation of the cleaning assembly of this invention.
Figure 4:
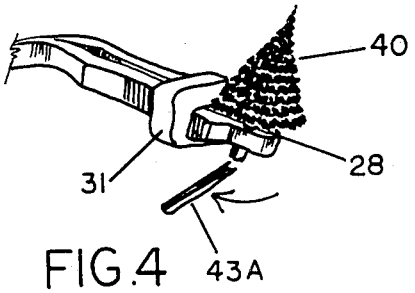

In FIG. 3, the brush handle 41 is shown being inserted into slit 14, and then moved along the slit, in the direction of the arrows, and into frictional engagement in slot 27. As shown in FIG. 4, the compression ring 31 is then moved along the parallel sidewalls in the direction shown by the arrows 17, 18 and also compresses the slot 27 to further secure tube 43. The end portion 43A of the tube 43 is then broken away.

Figure 5:
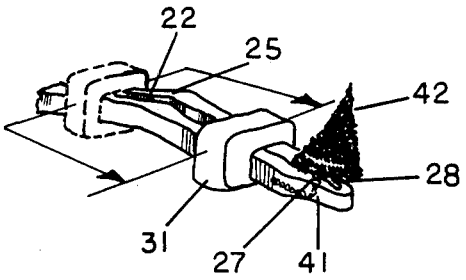

In FIG. 5, the brush handle 44 is inserted into slot 27 and bent around and back into slit 14. The compression ring 31 is then moved forward from the position shown in dotted designation to compress the parallel walls 17, 18 and close the slot 27 to further secure the brush. As in FIG. 4, the ridges 30 along the outer sides of the parallel walls 17, 18 improve frictional engagement between the ring and these walls.

Figure 6:
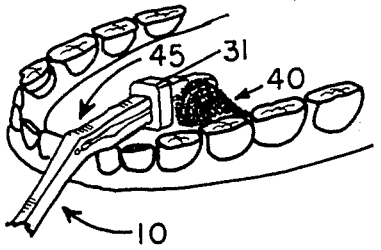

FIG. 6 illustrates the assembly 45 of the brush holder 10 and brush 40 for cleaning between the teeth in a direction from the inside to the front. In addition, the versatility of the assembly enables the cleaning brush to be used for cleaning along the face and back of the teeth, and also for massaging the gums. Following use, the brush is generally discarded and the brush holder can be easily cleaned. Because of its bristles, the brush provides a cleaning and massaging function that is both different and better than a toothpick, dental floss, or elongated rubber point; also, it can be better manipulated.

I claim:

1. A dental brush holder, comprising an elongate, plastic holder, including:

a. a central member;

b. end portions integrally formed at each end of the central member, and inclined thereto;

c. outwardly formed sidewalls provided by at least one end portion and defining respective slits, each slit comprising interior and exterior ends, stress relieving slots being defined at each of said interior and exterior ends, the said sidewalls of the slot being outwardly inclined at the exterior and interior ends, and being parallel medially of the ends;

d. a brush retaining slot defined within each slit; and, e. compression rings adapted to slide along their respective end portions and compress the sidewalls; whereby, i. when a dental cleaning brush is inserted into said brush retaining slot, it will be initially secured by frictional contact within the slot; ii. movement of the compression ring compresses the parallel sidewalls and the slit to further secure the brush within the slot; and, iii. retraction of the compression ring permits the sidewalls to expand, and enable removal of the brush.

2. A dental brush holder assembly, comprising an elongate injection molded plastic holder, including:

A.

a. a central member;

b. end portions integrally formed at each end of the central member, and inclined thereto;

c. outwardly formed sidewalls provided by at least one end portion and defining respective slits, each slit comprising interior and exterior ends, stress relieving slots being defined at each of said interior and exterior ends, the said sidewalls of the slot being outwardly inclined at the exterior and interior ends, and being parallel medially of the ends;

d. a brush retaining slot defined within each slit; and e. compression rings adapted to slide along their respective end portions and compress the sidewalls; and,

B.

a dental cleaning brush inserted into said brush retaining slot and being frictionally engaged thereby; whereby, i. movement of the compression ring compresses the sidewalls and the slit to further secure the brush within the slot; and, ii. retraction of the compression ring permits the sidewalls to expand, and enable removal of the brush.

3. The dental cleaning brush of claim 1, in which the dental brush holder includes:

a. a central elongate member;

b. end portions integrally formed at each end of the central member, and inclined thereto;

c. outwardly formed sidewalls provided by each end portion, and defining respective slits, each slit comprising interior and exterior ends, stress relieving slots being defined at each of said interior and exterior ends, the sidewalls being parallel medially of the ends;

d. a brush retaining slot defined within each slit; and, e. compression rings adapted to slide along their respective end portions and compress the sidewalls;

whereby, i. when a dental cleaning brush is inserted into said brush retaining slot, it will be initially secured by frictional contact within the slot; ii. movement of the compression ring compresses the parallel sidewalls and the slit to further secure the brush within the slot; and, iii. retraction of the compression ring permits the sidewalls to expand, and enable removal of the brush.

4. The dental brush holder of claim 1, in which the cleaning brush provides an integrally formed wire handle and bristle holder, the handle being encased in a breakable plastic tube; whereby, i. when the plastic tube portion of the dental cleaning brush is inserted into the slot and extended therefrom, the tube will be secured within the slot; and, ii. the portion of the plastic tube extending from the slot is adapted to be broken off at the slit, leaving the wire handle encased in the portion of the tube within the slit, and the cleaning bristles being exposed for use upwardly of the slot.

5. The dental brush holder assembly of claim 2, in which the cleaning brush provides an integrally formed wire handle and bristle holder, the handle being encased in a breakable plastic tube; whereby, i. when the plastic tube portion of the dental cleaning brush is inserted into the slot and extended therefrom, the tube will be secured within the slot; and, ii. the portion of the plastic tube extending from the slot is adapted to be broken off at the slit, leaving the wire handle encased in the portion of the tube within the slit, and the cleaning bristles being exposed for use upwardly of the slot.

6. The dental brush holder of claim 1, in which the plastic holder is manufactured of a material selected from the class consisting of nylon and polypropylene.

7. The dental brush holder of claim 2, in which the plastic holder is manufactured of a material selected from the class consisting of nylon and polypropylene.

8. The dental brush holder of claim 3, in which the plastic holder is manufactured of a material selected from the class consisting of nylon and polypropylene.

9. The dental brush holder of claim 1, in which the compression rings are softened in boiling water and are forced onto each end portions while still in the softened state.

10. The dental brush holder of claim 9, manufactured by a plastic injection molding process.

11. The dental brush holder assembly of claim 2, in which the compression rings are softened in boiling water and are forced onto each end portion while still in the softened state.

12. A dental cleaning brush adapted for use in a dental brush holder, including a wire handle defining upper and lower ends, a plurality of cleaning bristles being attached to the wire at the upper end, and the lower end of the brush being encased a portion of the way within a hollow, breakable plastic tube, the dental brush holder comprising a handle member providing a slot adapted to retain said dental cleaning brush, whereby:

i. when the plastic tube portion of the dental cleaning brush is inserted into the slot and extended therefrom, the tube will be secured within the slot; and, ii. the portion of the plastic tube extending from the slot is adapted to be broken off at the slit, leaving the wire handle encased in the portion of the tube within the slit, and the cleaning bristles being exposed for use upwardly of the slot.

13. The dental brush holder of claim 12, in which the brush holder is constructed of a deformable plastic, and the slot is deformed outwardly when the plastic tube is inserted therein.

14. The dental brush holder of claim 3, in which the cleaning brush provides an integrally formed wire handle and bristle holder, the handle being encased in said breakable plastic tube.

15. The dental brush holder of claim 3, in which the compression ring are softened in boiling water and are forced onto each end portion while still in the softened state.

16. The dental brush holder of claim 3, manufactured by a plastic injection molding process.

* * * * *